US005586463A

United States Patent [19]

Sheen

[11] Patent Number: 5,586,463

[45] Date of Patent: Dec. 24, 1996

[54] PIPE BENDING DEVICE

[76] Inventor: Reen-Yuan Sheen, P.O. Box 1-394, Chungho, Taipei Hsien, Taiwan

[21] Appl. No.: 515,643

[22] Filed: Aug. 17, 1995

[51] Int. Cl.[6] ..... B21D 5/14; B21B 39/02

[52] U.S. Cl. ..... 72/166; 72/169; 72/133

[58] Field of Search ..... 72/133, 150, 154, 72/166, 169, 170, 171, 172, 173, 184, 308, 311, 369, 406

[56] References Cited

U.S. PATENT DOCUMENTS

| | | | |
|---|---|---|---|
| 3,010,507 | 11/1961 | Hill | 72/150 |
| 3,016,081 | 1/1962 | Gill | 72/369 |
| 3,848,446 | 11/1974 | Iwasaki et al. | 72/171 |

*Primary Examiner*—David Jones
*Assistant Examiner*—Rodney Butler
*Attorney, Agent, or Firm*—Alfred Lei

[57] ABSTRACT

A pipe bending device which is composed of a drive wheel, a plurality of guide wheels, a pair of guide molds and a mandrel, wherein the guide wheels having a main guide wheel which is installed under the drive wheel, the pair of guide mold being composed of a first guide mold and a second guide mold which are engaged respectively with the drive wheel and the guide wheels and can be drived to move, the first guide mold being formed into a curve shape, the pipe being installed between the first guide mold, the end of the pipe being fixed at the end of the first guide mold, thus the pipe can be stretched and bended by the first guide mold to form a curve when the pair of guide molds being drived to move, the mandrel being inserted into the inner hole of the pipe so as to prevent the pipe from deforming in bending process As a result the inner surface of the bending part can be kept smooth.

4 Claims, 4 Drawing Sheets

PIPE BENDING DEVICE

BACKGROUND OF THE INVENTION

This invention relates to a pipe bending device which is composed of a drive wheel, a plurality of guide wheels, a pair of guide molds and a mandrel. The guide mold includes a first guide mold and a second guide mold which are engaged respectively with the drive wheel and the guide wheels, the first guide mold being formed into a curve shape, the mandrel being inserted into the inner hole of the pipe, the end of the pipe being fixed at the end of the first guide mold. Hence the pipe can be stretched and bended by the first guide mold to form a curve the same with the curve of the first guide mold.

The conventional pipe bending device is shown in FIG. 1. The roller (R1) can be adjusted upwardly or downwardly and rotated around the shaft (C1), the roller (R2) and the roller (R3) being installed below the roller (R1) and rotated respectively around the shaft (C2) and the shaft (C3), furthermore the roller (R2) and the roller (R3) being installed at the same level (L). The pipe (4) is located between the roller (R1) and the rollers (R2) (R3). The pressure on the pipe (4) can be adjusted by the roller (R1). As the pipe goes through the roller (R1) and the rollers (R2) (R3), it is bended into a curve shape. The bending curvature of pipe is decided by the vertical distance between the roller (R1) and the rollers (R2) (R3), more longer of the vertical distance, more larger of the bending curvature, i.e. the bending curvature of the pipe being controlled by the operator to adjust the vertical distance between the roller (R1) and the rollers (R2,R3). It is very difficult for an operator to get an accurate bending curvature under such a condition. In addition the inner surface of the bending part may be deformed or can't be kept smooth.

The rollers (R2) (R3) produce an upward reaction force(F) on the pipe as the pipe goes through between the roller (R1) and the rollers (R2) (R3) so that the pipe can be bended upwardly at its two ends. Hence the end of the pipe has a large deflection and may cause a curling at its end.

The FIG. 1A shows another conventional pipe bending device, the end of pipe being fixed at the circumference of a drive wheel (W), the drive wheel (W) being rotated around a shaft (W1) to bend the pipe, according to such a kind of pipe bending method, the curvature radius (S) of the pipe must be the same with the curvature radius (r) of the drive wheel (W). If the curvature radius of pipe is very large, the drive wheel (W) must be manufactured into large dimension that may cause a larger manufacturing cost. Furthermore, it is very inconvenient for an operator to install or carry the large drive wheel.

SUMMARY OF THE INVENTION

It is therefore the main object of this invention to provide a pipe bending device which is composed of a drive wheel, a plurality of guide wheels, a pair of guide molds and a mandrel, wherein the guide wheels having a main guide wheel which is installed under the drive wheel, the pair of guide molds being composed of a first guide mold and a second guide mold which are engaged respectively with the drive wheel and the guide wheels and can be drived to move, the first guide mold being formed into a curve shape, the pipe being installed between the first guide mold and the second guide mold, furthermore the end of the pipe being fixed at the end of the first guide mold, thus the pipe can be stretched and bent by the first guide mold to form a curve when the pair of guide molds being driven to move.

It is the another object of this invention to provide a pipe bending device, wherein the mandrel is inserted into the inner hole of pipe to support the pipe so as to prevent the pipe from deforming in bending process, thus keeping the inner surface of the bending part smooth.

BRIEF DESCRIPTION OF THE DRAWINGS

In the drawings, which illustrate the preferred embodiments and modes of operation of the invention, and in which like reference characters designate the same or similar parts throughout the several views.

DETAILED DESCRIPTION OF THE PREFERRED EMBODIMENT

Figure 4:
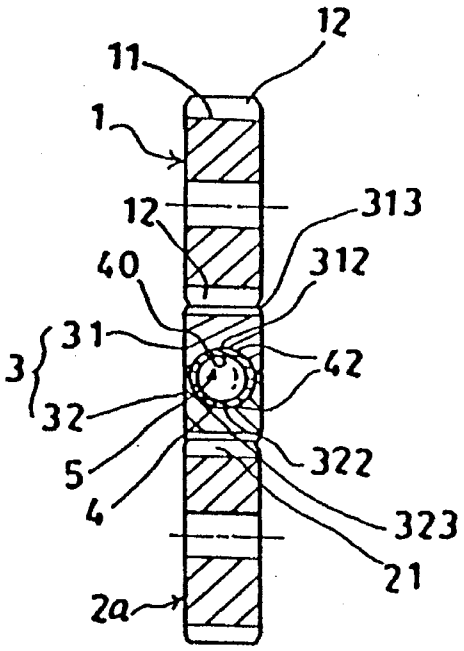
FIG. 4 is a sectional view on line 4—4 in FIG. 3.
Figure 3:
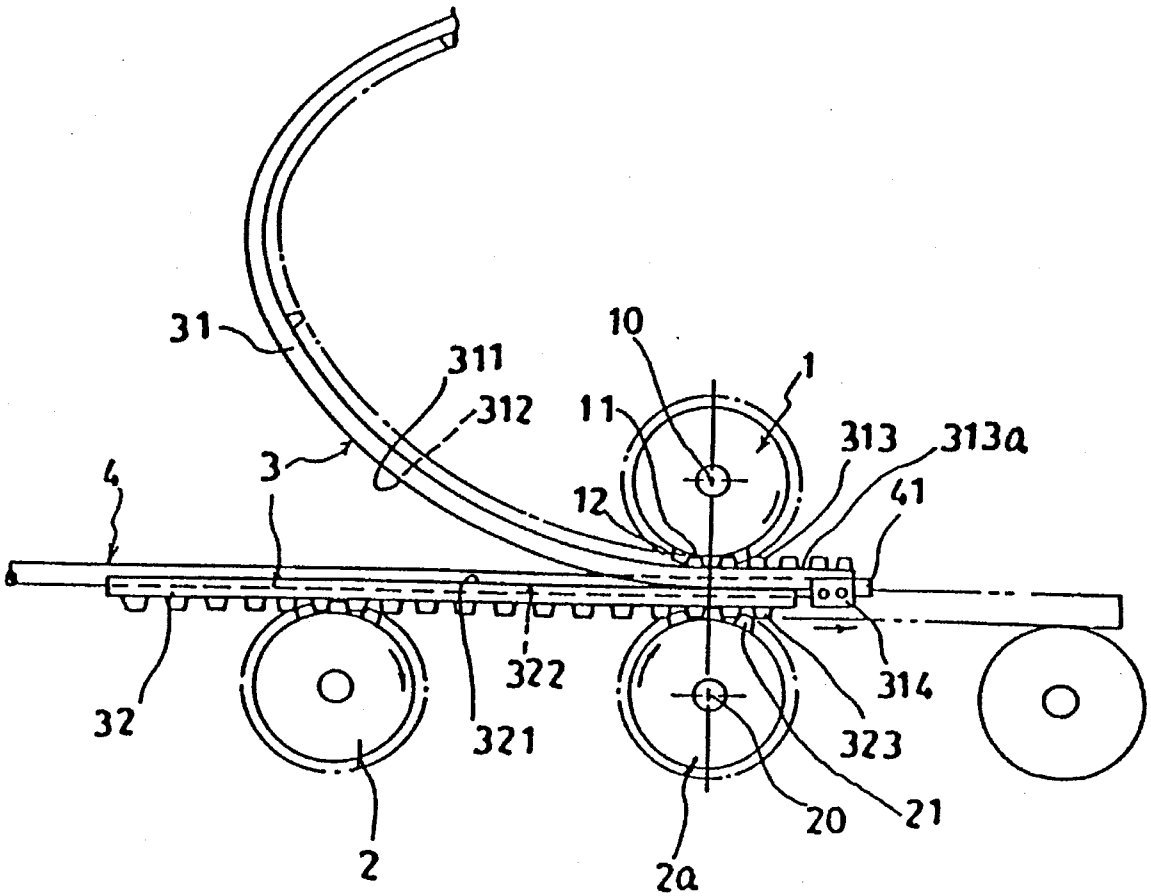
FIG. 3 is a plan view showing a pipe bending device of the present invention.

Referring to FIG. 3 and FIG. 4, the present invention relates to a pipe bending device which is composed of a drive wheel (1), a plurality of guide wheels (2), a pair of guide molds (3) and a mandrel (5), the top (20) of each guide wheel (2) being installed in line with each other, the shaft of the main guide wheel (2*a*) being faced with the shaft (10) of the drive wheel (1). The guide molds (3) are composed of a first guide mold (31) and a second guide mold (32), wherein the first guide mold (31) being driven by the drive wheel (1), furthermore the curve of the first guide mold (31) being manufactured according to desired pipe curve, the second guide mold (32) being driven by the guide wheels (2). The mandrel (5) has a link (52) formed at its end, which is inserted into the pipe (4). The sectional shape of the mandrel (5) can be a circular or rectangular shape . . . etc, which is manufactured according to the shape of inner hole (40) of the pipe (4). The pipe (4) is installed between the first guide mold (31) and the second guide mold (32). Further the end of the pipe (4) being fixed at the end of the first guide mold (31). The first guide mold (31) and the second guide mold (32) are driven respectively by the drive wheel (1) and the guide wheels (2), thus the pipe (4) can be bended by the first guide mold (31).

The drive wheel (1) can be adjusted far from or near to the main guide wheel (2*a*) in order to adjust the pressure between the drive wheel (1) and the main guide wheel (2*a*). The circumference of the drive wheel (1) have a plurality of teeth (12) which can be engaged with the gears (313) of the first guide mold (31).

The first guide mold (31) have a connecting means (314) which is composed of a bushing (314*a*) and a fixing bolt (314*b*), thus the end of the pipe (4) can be connected with the first guide mold (31) by means of fastening the fixing bolt (314*b*) and the bushing (314*a*). The inner side (313*a*) of the first guide mold (31) have a plurality of teeth (313), the total length of these teeth (313) must be at least equal to or longer than the desired pipe bending length, the outer side (311) of the first guide mold (31) having a first guide groove (312) which covers on the pipe (4) so as to locate the pipe (4).

The inner side (32*b*) of the second guide mold (32) have a plurality of guide teeth (323) which can be engaged with the teeth (21) of the guide wheels (2), the outer side (321) of the second guide mold (32) having a second guide groove (322) which is covered by the bottom of the pipe (4) so as to locate the pipe (4). The guide wheels (2) are installed at the same level. The the pitch points between the second guide mold (32) and the guide wheels (2) are all at the same level. The shaft distance between any two guide wheels (2) is shorter than ½ length of the second guide mold (32).

The mandrel (5) has a link (52) formed at its end, the end of the link (52) being connected to a cylinder, thus the mandrel (5) can be moved forwardly or backwardly by means of a cylinder.

Figure 5:
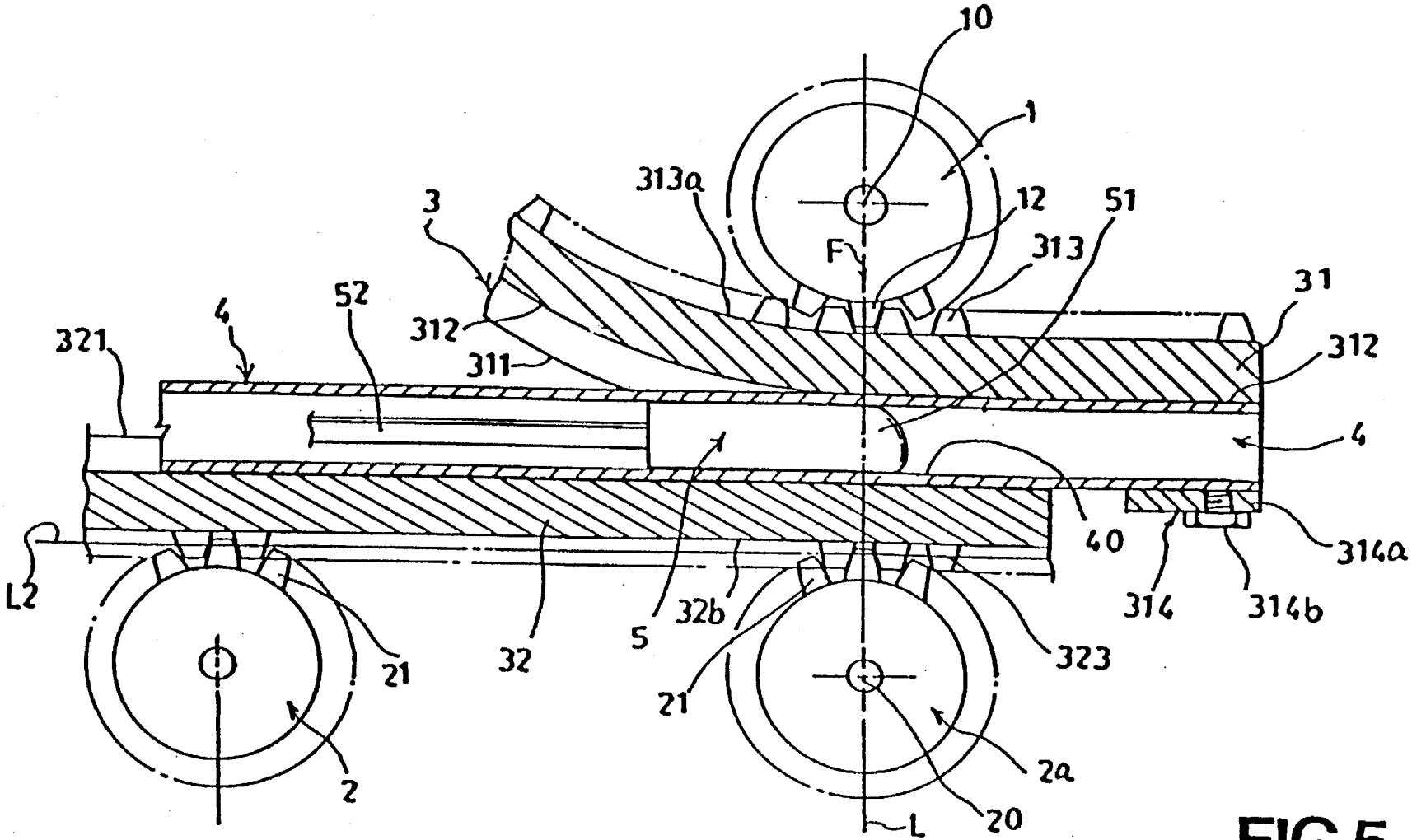
FIG. 5 is a sectional view showing the details of the pipe bending device.
Figure 6:
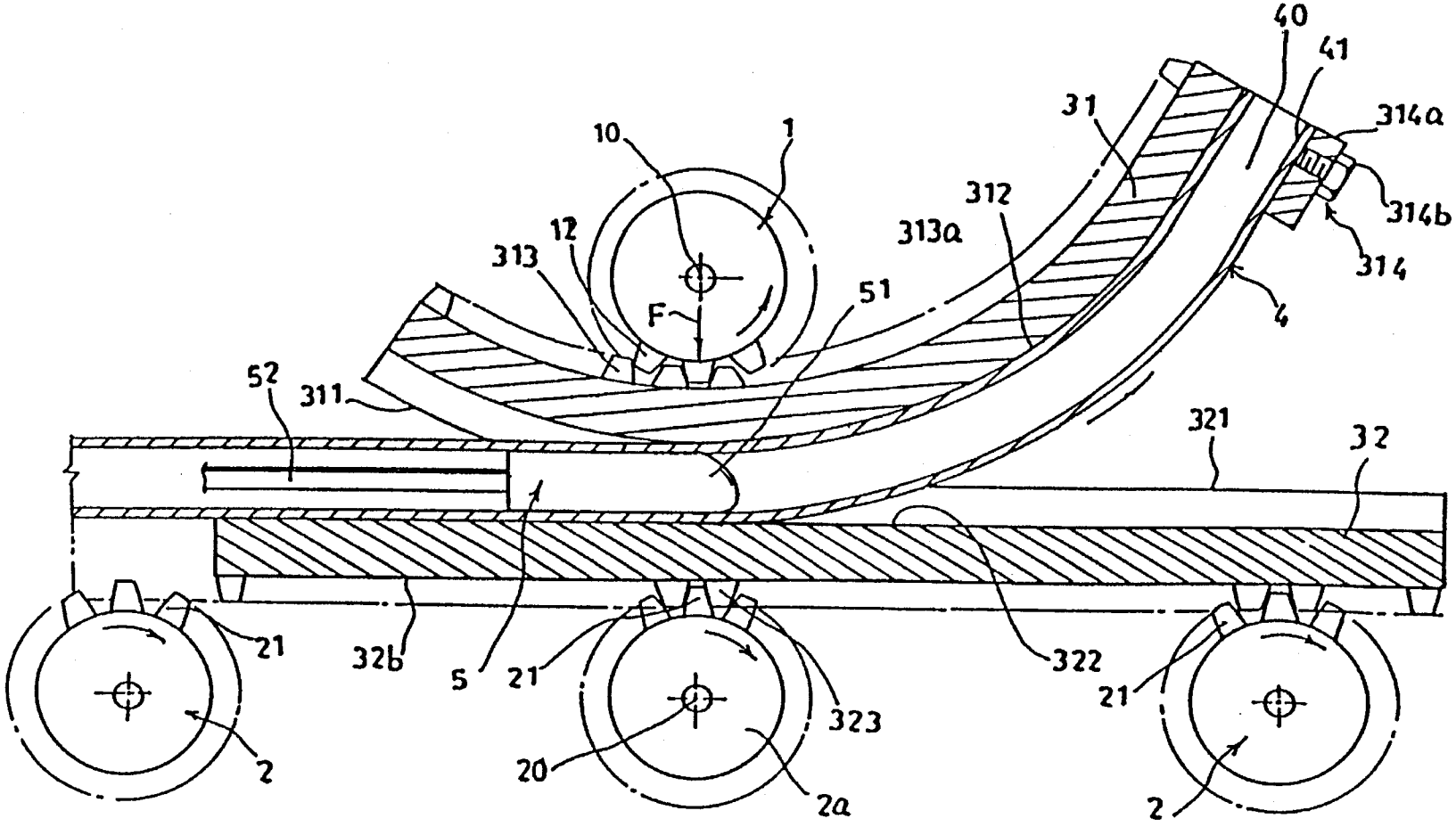
FIG. 6 is a sectional view illustrating the pipe bending process of this invention.

Referring to FIG. 5 and FIG. 6, the pipe (4) is installed between the first guide mold (31) and the second guide mold (32), the end of the pipe (4) being connected with the end of the first guide mold (31). As the drive wheel (1) and the guide wheels (2) start to drive the pair of guide molds (3), the pipe (4) would be stretched and bent by the first guide mold (31). Consequently, the pipe (4) can be bent against the curve of the first guide mold (31), the mandrel (5) being inserted into the inner hole (4*b*) of the pipe (4) to support the pipe (4) so as to prevent the pipe (4) from deforming. Moreover the inner surface of the pipe (4) can be kept smooth after bending. The bent pipe (4) can be removed from the first guide mold (31) by loosening the fixing bolt (314*b*).

The curve of the first guide mold ((31) is formed according to the desired pipe bending curve. Accordingly, the operator only needs to replace the first guide mold (31) with the new one with appropriate curve if the operator would like to get any other pipe bending curve.

Figure 1:
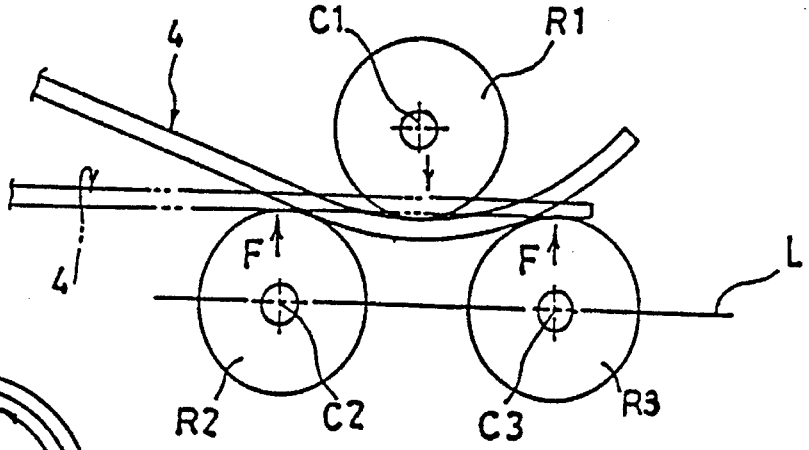
PRIOR ART FIG.1
FIG. 1 is a plan view showing the conventional method for pipe bending working.
Figure 1A:
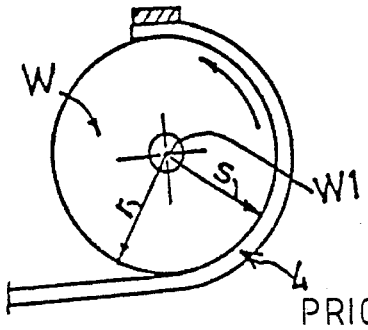
PRIOR ART FIG.1A
FIG. 1A is a plan view showing another conventional method for pipe bending working.
Figure 2:
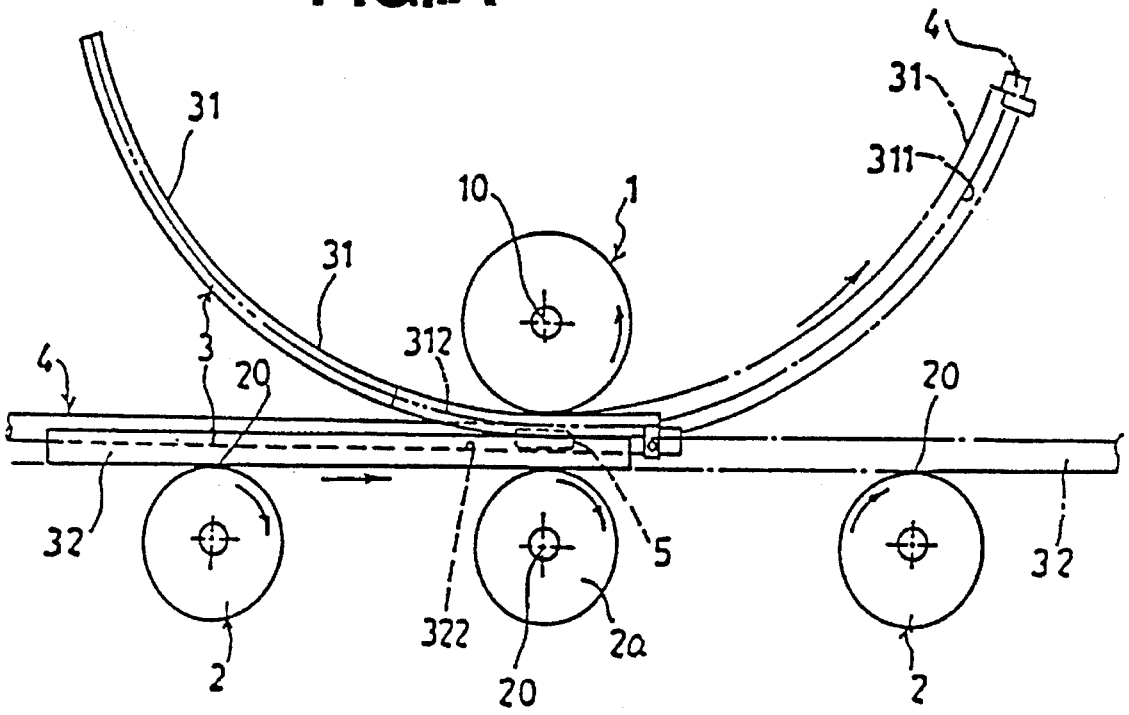
FIG. 2 is a plan view showing a pipe bending method of the present invention.

The present invention also provides a pipe bending method, such as shown in the FIG. 2, the pipe (4) being installed between the first guide mold (31) and the second guide mold (32). The front end (41) of the pipe (4) is fixed at the front end of the first guide mold (31). The inner side of the first guide mold (31) having a plurality of gears (313) which is engaged with the teeth (12) of the drive wheel (1), the inner side of the second guide mold (32) having a plurality of guide gears (323) which is engaged with the teeth (21) of the guide wheels (2). The first guide mold (31) is manufactured into a curve shape which is the same with the desired pipe bending curve, the mandrel (5) being inserted into the inner hole of the pipe (4) in order to prevent the pipe (4) from deforming in bending process. Hence the inner surface of the bending part of the pipe (4) can be kept smooth after stretching and bending work. As the drive wheel (1) and the guide wheels (2) start to drive the pair of guide molds (3), the first guide mold (31) and the second guide mold (32) would move forwardly and the pipe (4) would be stretched and bent by the first guide mold (31), the bending curve of the pipe (4) being formed the same with the curve of the first guide mold (31).

The outer sides of the first guide mold (31) and the second guide mold (32) have respectively a first guide groove (312) and a second guide groove (322) between which the pipe (4) can be installed and located. The front end (51) of the mandrel (5) is extended out of the central line (L) of the drive wheel (1) and the main guide wheel (2*a*), the front end (51) of the mandrel (5) being formed into a curve to match the curve of the bending part of the pipe (4). The mandrel (5) can be removed from the inner hole of the pipe (4) if the pipe (4) has a thick pipe wall or a great curvature.

It is understood by those skilled in the art that the forgoing description is a preferred embodiment of the disclosed device and that various changes and modifications may be made in the invention without departing from the spirit and scope thereof.

What is claimed is:

1. A pipe bending device comprising:

a drive toothed wheel;

a plurality of guide toothed wheels arranged at a same level and oppositely to said drive toothed wheel;

a first guide mold located under said drive toothed wheel and having teeth engaged with said drive toothed wheel;

a second guide mold disposed on said guide toothed wheels and having teeth engaged with said guide toothed wheels;

a mandrel adapted to be inserted into a pipe to be bent and having a link at an end thereof, said pipe having an end which will be fastened on an end of said first guide mold in operation.

2. The pipe bending device as claimed in claim 1, wherein said drive toothed wheel is adjustable in relative position to said first guide mold.

3. The pipe bending device as claimed in claim 1, wherein said first guide mold is provided at an outer end thereof with connecting means including a bushing fixedly attached to said outer end and a bolt engaged with said bushing.

4. The pipe bending device as claimed in claim 1, wherein said first guide mold and said second guide mold are each formed with a guide groove for receiving said pipe.

* * * * *